US005958152A

United States Patent [19]

Nakahama et al.

[11] Patent Number: 5,958,152

[45] Date of Patent: Sep. 28, 1999

[54] CHROMIZED HEAT-RESISTANT ALLOY MEMBERS AND A PROCESS FOR THE PRODUCTION THEREOF

[75] Inventors: Shuhei Nakahama; Hisamichi Nagahara, both of Chiba-ken; Masamichi Kawasaki, Tokyo; Yoshio Harada, Hyogo-ken, all of Japan

[73] Assignees: Ebara Corporation, Tokyo; Tocalo Co., Ltd., Kobe, both of Japan

[21] Appl. No.: 08/862,692

[22] Filed: May 23, 1997

Related U.S. Application Data

[60] Continuation of application No. 08/626,028, Apr. 1, 1996, abandoned, which is a division of application No. 08/400, 868, Mar. 8, 1995, abandoned.

[30] Foreign Application Priority Data

Mar. 9, 1994 [JP] Japan ..... 6-064398
Jan. 31, 1995 [JP] Japan ..... 7-032813

[51] Int. Cl.[6] ..... C23C 8/00

[52] U.S. Cl. ..... 148/240; 148/516; 148/527; 148/537; 148/714; 427/185; 427/253; 427/295; 427/383.7; 428/667; 428/941

[58] Field of Search ..... 148/240, 516, 148/537, 527, 714; 427/253, 295, 383.7, 185; 428/667, 941

[56] References Cited

U.S. PATENT DOCUMENTS

| | | | |
|---|---|---|---|
| 2,816,048 | 12/1957 | Galmiche | 427/253 |
| 3,664,765 | 5/1972 | Ishimatsu | 428/667 |
| 4,485,148 | 11/1984 | Rashid | 428/667 |

*Primary Examiner*—David A. Simmons
*Assistant Examiner*—Robert R. Koehler
*Attorney, Agent, or Firm*—Oblon, Spivak, McClelland, Maier & Neustadt, P.C.

[57] ABSTRACT

To provide heat-resistant alloy members that maintain the resistance to corrosion at high temperature of the chromized layer formed on Ni- or Co-base heat-resistant alloys and which yet are improved in various mechanical properties. The improved Ni- or Co-base heat-resistant alloy member having a chromized layer that is characterized by having a chromium concentration of 25–80% and a thickness of 10–100 μm. This member is produced by controlling both the vapor pressure of a chromium halide being used in chromization and the temperature therefor in such a way that the chromized layer being formed is adjusted to have a chromium concentration and a thickness within the ranges specified above.

21 Claims, 5 Drawing Sheets

CHROMIZED HEAT-RESISTANT ALLOY MEMBERS AND A PROCESS FOR THE PRODUCTION THEREOF

This application is a continuation of application Ser. No. 08/626,028, filed on Apr. 1, 1996, now abandoned, which is a division of application Ser. No. 08/400,868, filed on Mar. 8, 1995, abandoned.

FIELD OF THE INVENTION

The present invention relates to chromized heat-resistant alloy members, more particularly, to Ni- or Co-base heat-resistant alloy members having a chromized layer that are adapted for use in environments where high mechanical loads are applied in a hot, corrosive atmosphere.

PRIOR ART

Chromization is one of the conventional treatments that are commonly performed on iron and steel members. To implement this process, a penetrant containing a large amount of metallic chromium is placed in a carbon steel container together with the member to be treated and heated at high temperature in an inert gas or hydrogen gas atmosphere so that metallic chromium is precipitated out on a surface of the member being treated while, at the same time, it diffuses into the latter.

Depending on the form of the penetrant used, the chromization process is classified as a solid-phase procedure (powder procedure), a gas-phase procedure, a liquid-phase procedure and the like. In the solid-phase procedure, a penetrant composed of 50–55% of a metallic chromium powder, 45–55% alumina and 0.5–1.0% ammonium chloride (all percentages being by weight) is placed in a carbon steel container together with the member to be treated and maintained at a temperature of 800–1,000° C. several to several tens of hours under an argon or hydrog gas stream, thereby forming a chromized layer.

In chromization by the gas-phase procedure, a chromium halide such as chromium chloride or chromium bromide is reacted in the vapor state with the member to be treated, thereby forming a chromized layer. If, for example, chromium chloride gas and hydrogen gas are brought into contact with the hot member to be treated, metallic chromium is precipitated out on a surface of the member being treated and diffuses into the latter, thereby forming a chromized layer.

In the liquid-phase procedure, the member to be treated is dipped in a chromium-containing molten salt, thereby forming a chromized layer.

In another known method, a chromium layer is formed by electroplating on a surface of the member to be treated, which is then heated so that the chromium diffuses into the bulk, thereby forming a chromized layer.

As described above, several chromizing processes are known but the solid- and gas-phase procedures are the only two processes that are practiced on an industrial scale and the other methods are merely applied in special areas since they are low in productivity and uneconomical.

The solid- and gas-phase procedures are entirely the same in the mechanism by which chromium is precipitated out on the member to be treated. Even in the solid-phase procedure, a penetrant is heated at high temperature arnd a gaseous chromium halide is generated by the action of a halogen compound such as an ammonium chloride, whereupon it reacts with the member being treated to form a chromized layer. Thus, the metallic chromium powder in the penetrant only serves as a source of supply of the chromium halide, which makes the solid-phase procedure essentially the same as the gas-phase procedure using chromium halides as far as the mechanism of chromium precipitation is concerned.

The reactions involved in the precipitation of chromium may be summarized as follows:

$$CrX_2+Me \rightarrow Cr+MeX_2 \quad (1)$$

$$CrX_2+H_2 \rightarrow Cr+2HX \quad (2)$$

where X is a halogen element such as Cl, Br or F. and Me is the metal element of which the member to be treated composed. Equation (1) represents a so-called "exchan reaction", by which Cr is easily precipitated out if the member to be treated is composed of a metal element (e.g. Fe) that forms a halogen compound having a higher vapor pressure than Cr. However, if the member to be treated is chiefly composed of a non-ferrous metal such as Ni, Co or Mo, halogen compound of such metals have lower vapor pressures than $CrX_2$ and, hence, Cr will hardly precipitate out according to equation (1). In other words, if the member to be treated is made of a non-ferrous metal, Cr must be precipitated out by reduction with hydrogen in accordance with equation (2).

Under the circumstances, it is recommended that the chromization of Ni- or Co-base heat-resistant alloys intended for use with members that are to be exposed to high temperature as in gas turbines, blades in jet engines and the liner of burners should be performed exclusively by a process that depends on the reaction expressed by equation (2) (see, for example, Japanese Patent Publication Nos. 30321/1970 and 49627/1967).

Thus, whether the solid-phase or gas-phase procedure is to be employed in chromizing Ni- or Co-base heat-resistant alloys, emphasis is placed on the reaction for Cr precipitation and little interest is taken in the phenomenon of diffusion into the member being treated and its effective utilization. The chromization of heat-resistant alloys of these types has heretofore been conducted primarily for the purpose of achieving resistance to oxidation and corrosion under elevated temperatures (which is hereunder collectively referred to as "resistance to corrosion at high temperature"), so researchers have paid more attention to the concentration of Cr in the surface chromized layer than the phenomenon of diffusion and, as a result, their efforts have mostly been directed to searching for the conditions of Cr precipitation that will facilitate the formation of a highly chromized layer. The reason behind this situation is that the rate of Cr diffusion through Ni- or Co-base heat-resistant alloys is generally small, so if Cr that is precipitated out in the vapor phase is deposited on a surface of the heat-resistant alloy, a highly chromized layer will inevitably form.

The highly chromized layer on Ni- or Co-base heat-resistant alloys that is formed by the above-described existing chromization processes proves effective in assuring resistance to corrosion at high temperature; however, under such environmental conditions that strong tensile stresses, fatigue, mechanical contact and other loads are applied in a hot atmosphere containing sulfur compounds, cracks tend to develop in the high-Cr concentration area of the topmost surface zone of the chromized layer and, in addition, this becomes a starting point for the growth and propagation of cracks, potentially leading to a serious accident.

SUMMARY OF THE INVENTION

The present invention has been accomplished in order to solve these problems of the prior art. An object, therefore, of the invention is to provide chromized heat-resistant alloy members that maintain the resistance to corrosion at high temperature of the chromized layer formed on a Ni- or Co-base heat-resistant alloy and which yet are improved in various mechanical properties.

Another object of the invention is to provide a process for producing such improved chromized heat-resistant alloy members.

Other objects and advantages of the present invention may become apparent to those skilled in the art from the following description and disclosure.

DETAILED DESCRIPTION OF THE INVENTION

Figure 1A:
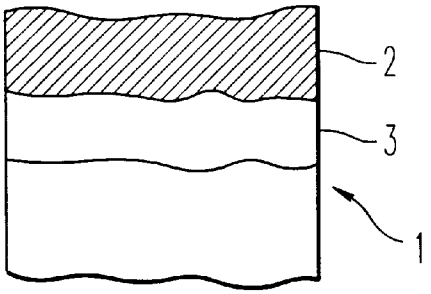
FIG. 1A is a cross section showing diagrammatically a prior art example of a chromized Ni-base heat-resistant alloy.

The first object of the invention can be attained by a Ni- or Co-base heat-resistant alloy member having a chromized layer that is characterized in that said chromized layer has a chromium concentration of 25–80%, preferably 25–75% and a thickness of 10–100 $\mu$m, preferably 10–40 $\mu$m.

The second object of the invention can be attained by a process for producing a chromized heat-resistant alloy member by chromizing a Ni- or Co-base heat-resistant alloy, characterized in that the vapor pressure of a chromium halide being used in chromization and the temperature therefor are controlled in such a way that the chromized layer being formed is adjusted to have a chromium concentration of 25–80% in the chromized layer and a thickness of 10–100 $\mu$m.

In the process, the chromization is preferably performed by the solid- or gas-phase procedure.

As mentioned above, the present invention, when performing chromization on a Ni- or Co-base heat-resistant alloy, adopts the procedure to be outlined below so that the concentration of Cr in the chromized layer being formed and the thickness of the chromized layer are adjusted to lie within the above-specified ranges, thereby producing a heat-resistant alloy member that is improved not only in resistance to corrosion with sulfides but also in mechanical strength.

(1) The partial pressure of a chromium halide that takes part in the reaction of Cr precipitation is controlled so as to adjust the amount of Cr being precipitated out; and (2) While the partial pressure of the chromium halide is controlled, the chromizing temperature is varied so as to adjust the concentration of Cr in the surface chromized layer and the thickness of the chromized layer.

In a specific embodiment, the process is applied to the chromizing of a Ni-base heat-resistant alloy and in this case the vapor pressure of chromium chloride is controlled to lie within the range 0.7–7 mmHg and the temperature for chromization within the range 850–970° C. in such a way that the chromized layer being formed is adjusted to have a chromium concentration of 25–80% in the chromized layer and a thickness of 10–40 $\mu$m.

In another specific embodiment, the process is applied to the chromizing of a Co-base heat-resistant alloy and in this case the vapor pressure of chromium chloride is controlled to lie within the range 4–47 mmHg and the temperature for chromization within the range 950–1,100° C. in such a way that the chromized layer being formed is adjusted to have a chromium concentration of 25–80% in the chromized layer and a thickness of 10–100 $\mu$m.

The mechanism of chromization to which the present invention is to be applied will now be described.

As already mentioned, the process of chromization, whether it is performed by the solid- or gas-phase procedure, proceeds in the following sequence:

(1) in the atmosphere of treatment, Cr is liberated and precipitated out of the Cr halide by reduction with hydrogen;

(2) the fine particles of Cr that has thus precipitated out are deposited on a surface of the member being treated; and (3) the deposited fine Cr particles will diffuse into the member being treated.

If the reaction (2) is faster than the reaction (3), the chromized layer formed on a surface of the member being treated has a high Cr concentration area as shown by section in FIG. 1A. In FIGS. 1–3, numeral 1 denotes the member being treated, 2 refers to a deposited layer with high Cr concentration, and 3 designates a diffusion layer.

Figure 1B:
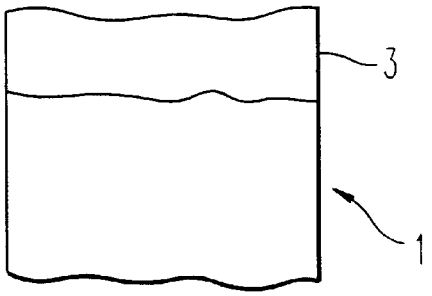
FIG. 1B is a cross section showing diagrammatically the same alloy as FIG. 1A according to an example of the present invention.

If, on the other hand, the reaction (2) is slower than the reaction (3), no deposited layer having high Cr concentration will form as shown in FIG. 1B and only a diffusion layer forms.

If the chromized member is to be used merely after chromium diffusion since the only purpose of the treatment is to provide corrosion resistance, the coat having the profile shown in FIG. 1B will serve the purpose. As for Ni- or Co-base heat-resistant alloys, chromization is often followed by a post-heat treatment such as stabilization or aging so as to restore the mechanical properties of the base material. If such post-heat treatments are conducted, they may occasionally oxidize part of the chromium diffusion layer or cause dechromization or, alternatively, chromium may diffuse further into the base material.

Figure 2A:
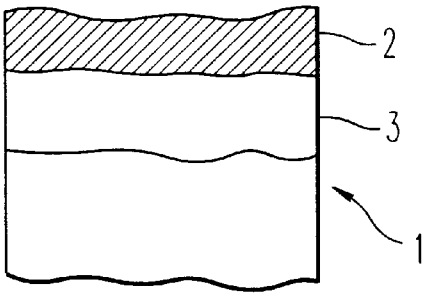
FIG. 2A is a cross section showing diagrammatically a prior art example of another chromized Ni-based heat-resistant alloy.
Figure 2B:
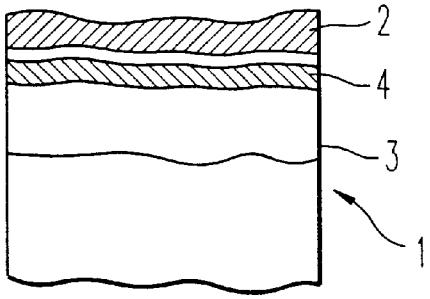
FIG. 2B is a cross section showing diagrammatically the same alloy as FIG. 2A according to an example of the present invention.
Figure 3A:
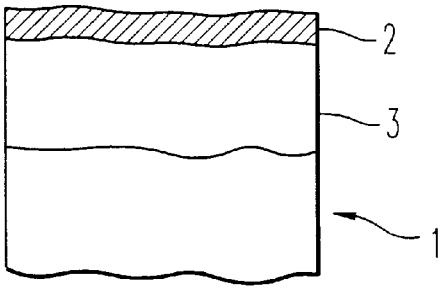
FIG. 3A is a cross section showing diagrammatically a prior art example of yet another chromized Ni-base heat-resistant alloy.
Figure 3B:
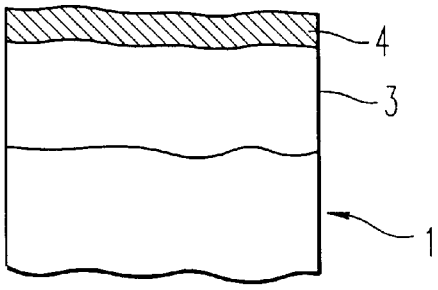
FIG. 3B is a cross section showing diagrammatically the same alloy as FIG. 3A according to an example of the present invention.

The deposition layer of high Cr concentration (about 55–80%) is dense compared with the diffusion layer and, hence, is characterized by resistance to the entrance of corrosive gas components. Therefore, it is advantageous to have some part of the precipitation layer of high Cr concentration remain intact if the phenomenon of dechromization is likely to occur. FIGS. 2A and 3A show cross sections for the case of chromization with some part of the additive layer of high Cr concentration being left intact. FIGS. 2B and 3B show cross sections for the case of performing a post-heat treatment, in which numeral 4 refers to an additive layer of medium Cr concentration (about 50%) that forms as a result of diffusion after the post-heat treatment at a temperature of from about 600° to about 1000° C. There are two such types of the additive layer of high Cr concentration. A coat of the type shown in FIG. 3B is the best suited to the purpose of the present invention but there is no problem if an additive layer of high Cr concentration remains in a thickness as small as shown in FIG. 2B. It should, however, be noted that an additive layer of excessively high Cr concentration as shown in FIG. 1A has the potential hazard of crack development as already mentioned hereinabove.

The present invention intends to produce a chromized layer that has the structure shown in FIG. 1B, 2B or 3B and which has a thickness of 10–100 μm. If the thickness of the chromized layer is smaller than 10 μm, the desired resistance to corrosion at high temperature is not achieved; if the thickness is greater than 100 μm, the mechanical strength of the layer is poor enough to cause early development of cracks and accelerate the speed of their propagation. To produce a chromized layer having the features described above, the following procedure may specifically be employed:

(1) the partial pressure of the vapor of Cr halide in the chromizing atmosphere is adjusted so as to control the amount of Cr being precipitated out in the atmosphere;

(2) the partial pressure of $H_2$ in the chromizing atmosphere is adjusted so as to control the amount of Cr being precipitated out;

(3) while conditions (1) and (2) are maintained, the chromizing temperature is varied so as to adjust the thickness of the chromized layer being formed on the member being treated.

Take, for example, the case of using $CrCl_2$ as a Cr halide. The relationship between the vapor pressure (mmHg) of this chloride and temperature is expressed by the following equation:

$$\log P = 27.50 - 5.03 \log T - 13800/T$$

where P is the vapor pressure (mmHg) and T is the absolute temperature. This equation states that the vapor pressure of $CrCl_2$ at 1,000° C. is about 11 mmHg. With ample supply of $H_2$ gas, all of the $CrCl_2$ present is reduced to fine Cr particles, which are mainly precipitated out on a surface of the member being treated while a part of them diffuses into the bulk.

In the conventional chromizing processes, the amount of Cr thus being precipitated out on a surface of the member being treated is sufficiently increased to provide better corrosion resistance. In the present invention, the quantity of the reactant $H_2$ gas is reduced or the vapor pressure of $CrCl_2$ is held low so that the amount of Cr being precipitated out within the atmosphere, or the amount of Cr being precipitated out on a surface of the member being treated, is adjusted, whereby the chromized layer is eventually controlled to have a chromium concentration within the range 25–80%, preferably 25–75% and a thickness within the range 10–100 μm, preferably 10–40 μm.

The vapor pressure of chromium chloride and the chromizing temperature for adjusting the Cr concentration and thickness of the chromized layer are adjusted to lie within the respective ranges of 0.7–7 mmHg and 850–970° C. for Ni-base alloys and 4–47 mmHg and 950–1,100° C. for Co-base alloys. The chromized layer that suits the purposes of the present invention can be produced by controlling the vapor pressure of chromium chloride and the chromizing temperature to lie within these ranges.

The above-described chromizing treatment may be directly applied to shaped articles while ensuring that their surface roughness and dimensional precision are maintained within design tolerances.

While the chromizing treatment has been described above with particular reference to the case of using $CrCl_2$, it should be noted that the chromium halide that can be used is by no means limited to $CrCl_2$ and that other chromium halides such as $CrBr_2$ and $CrF_2$ may also be used; in these alternative cases, too, the vapor pressures of the respective chromium halides and the chromizing temperature may be so adjusted as to attain the Cr concentration and diffusion thickness of the chromized layer that suit the purposes of the present invention.

EXAMPLES

The following examples are provided for the purpose of further illustrating the present invention but are in no way to be taken as limiting.

Example 1

Figure 4:
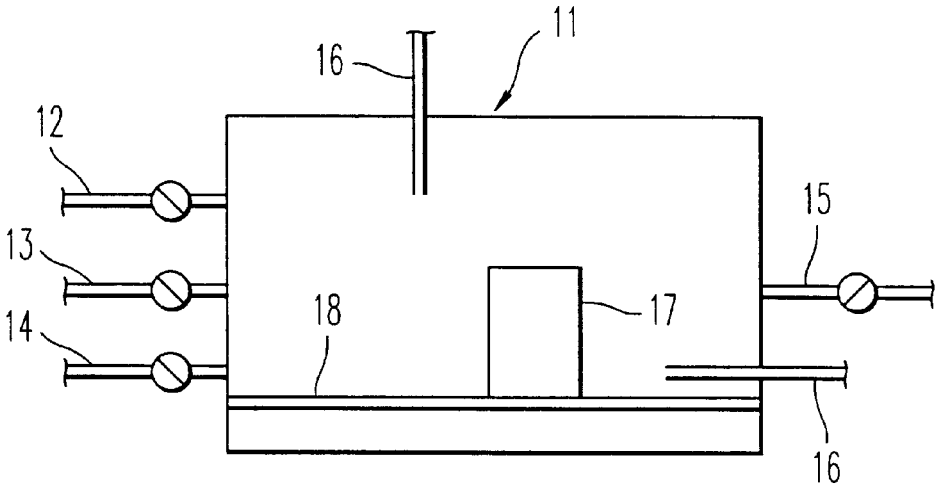
FIG. 4 shows the general layout of the experimental setup used in Example 1.

An experimental setup of the layout shown in FIG. 4 was used to prepare heat-resistant alloy members according to the present invention. Numeral 11 in FIG. 4 refers to a chromizing vessel made of Ni; 12 is a Cr halide vapor supply pipe; 13 is an Ar gas supply pipe; 14 is a $H_2$ gas supply pipe; and 15 is a gas exhaust pipe. Pipes 12–14 are furnished with valves capable of regulating the supply of respective gases; pipe 15 is also furnished with a valve capable of regulating the discharge of exhaust gas. The whole part of the chromizing vessel is placed in an electric furnace so that it can be heated from the outside. Further referring to FIG. 4, numeral 16 is a tube for measuring the temperature in the chromizing vessel; and 17 is the member to be treated which can be placed on a porous plate 18 made of an alumina sinter.

Using this experimental setup, the following two types of heat-resistant alloys were chromized and the concentration of Cr in the layer precipitated out on a surface of each heat-resistant alloy and the thicknesses of both the additive layer and the diffusion layer were measured with an X-ray microanalyzer.

(1) Ni-base heat-resistant alloy (0.04C-15Cr-25Ti-7Fe-bal. Ni)

(2) Co-base heat-resistant alloy (0.5C-26Cr-10Ni-7.5W-2Fe-1Mn-bal. Co.)

The figures in parentheses represent percentages by weight and each test piece was in a tubular form having a diameter of 15 mm and a length of 80 mm.

A $CrCl_2$ atmosphere having a saturation vapor pressure of about 47 mmHg at 1,100° C. was created in the chromizing vessel, which was supplied with $H_2$ in a volume 1.5 times as great as one equivalent for the reaction represented by the scheme $CrCl_2 + H_2 \rightarrow Cr + 2HCl$, so that the test pieces were chromized for 10 h.

In another run, chromizing was conducted under the same conditions as set forth above, except that the vapor pressure of $CrCl_2$ was adjusted to 2 mmHg (equal to the vapor pressure at 900° C.).

The results of the experiment are shown in Table 1.

TABLE 1

| Material of test piece | Vapor pressure of $CrCl_2$ | Additive layer Cr Conc. | Additive layer Thickness | Diffusion layer thickness |
|---|---|---|---|---|
| Ni-base alloy | 47 mmHg | 70–77 | 30 | 70 |
| Co-base alloy | | 70–79 | 15 | 30 |
| Ni-base alloy | 2 mmHg | 40–45 | 5 | 68 |
| Co-base alloy | | 48–53 | 2 | 28 |

Notes:
(1) Cr concentration is expressed in wt %.
(2) Thickness is expressed in $\mu$m.

As Table 1 shows, both the Ni- and Co-base heat-resistant alloy samples that were chromized in the atmosphere having the higher vapor pressure of $CrCl_2$ had very high concentrations of Cr in the additive layer formed on their surface; in addition, the additive layer was as thick as 30 $\mu$m in the Ni-base sample and 15 $\mu$m even in the Co-base sample. The thickness of the diffusion layer was 70 $\mu$m in the Ni-base sample and 30 $\mu$m in the Co-base sample (the thickness of the diffusion layer in the Co-base sample was small because the C content of the alloy was so high that the additive Cr was precipitated out and fixed as a carbide).

In contrast, when chromization was performed in the atmosphere having the lower vapor pressure of $CrCl_2$, the Cr concentration of the additive layer dropped to 40–45% in the Ni-base sample and 48–54% in the Co-base sample. However, the thickness of the diffusion layer decreased by only about 10% in both the Ni- and Co-base samples.

This would be explained as follows: in the atmosphere having the lower vapor pressure of $CrCl_2$, the amount of Cr that was precipitated out on a surface of a test piece decreased but the rate of Cr diffusion into the test piece did not change very much on account of high temperature, causing a corresponding decrease in the additive Cr concentration.

Example 2

Chromizing was conducted in Example 2 by the solid-phase procedure, using test pieces that were made of the same material and which had the same shape and dimensions as those used in Example 1

Figure 5:
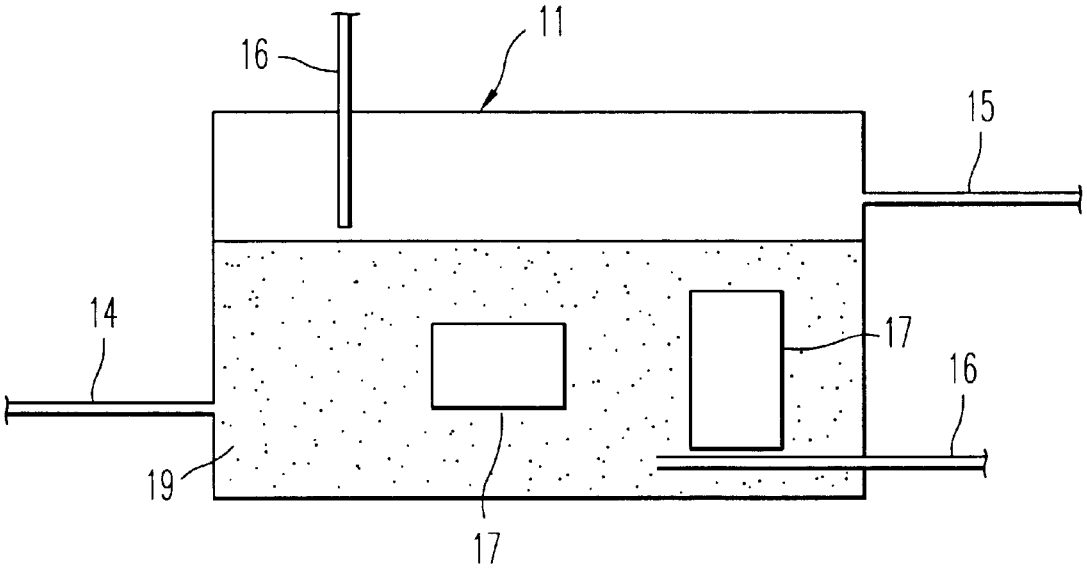
FIG. 5 shows the general layout of the experimental setup used in Example 2.

FIG. 5 shows the general layout of the experimental setup used in Example 2. Numeral 11 in FIG. 5 refers to a chromizing vessel made of Ni; 14 is a $H_2$ gas supply pipe; 15 is a gas exhaust pipe; 16 is a tube that is inserted into the vessel for measuring the temperature in it. The whole part of the vessel is placed in an electric furnace so that it can be heated from the outside. Further referring to FIG. 5, numeral 17 is a test piece, and 19 is a Cr penetrant that consists of 70% of a Cr powder, 29% $Al_2O_3$, and 1.0% ammonium chloride ($NH_4Cl$), with all percentages being by weight.

Chromization by the solid-phase procedure was performed for a fixed time of 10 h and at a temperature that was varied from 600 to 1,100° C. After chromization, the concentration of Cr in an additive layer of each test piece and the thickness of the diffusion layer were measured. The vapor pressure of $CrCl_2$ varied from $13\times10^{-4}$ to 47 mmHg over the range of chromizing temperatures employed.

The solid-phase procedure does not permit the vapor of $CrCl_2$ to be supplied externally but at temperatures higher than 338° C., $NH_4Cl$ in the penetrant decomposes to generate HCl, which reacts with the Cr powder to produce $CrCl_2$ according to the reaction expressed by the following formulae:

$$NH_4Cl \rightarrow NH_3 + HCl$$

$$2HCl + Cr \rightarrow CrCl_2 + H_2$$

The vapor pressure of the thus produced $CrCl_2$ is constant at a given temperature; therefore, if $H_2$ gas is present in the atmosphere in a sufficient amount, the amount of Cr that is yielded by reduction with $H_2$ gas would also assume a constant value:

$$CrCl_2 + H_2 \rightarrow Cr + 2HCl$$

Figure 6:
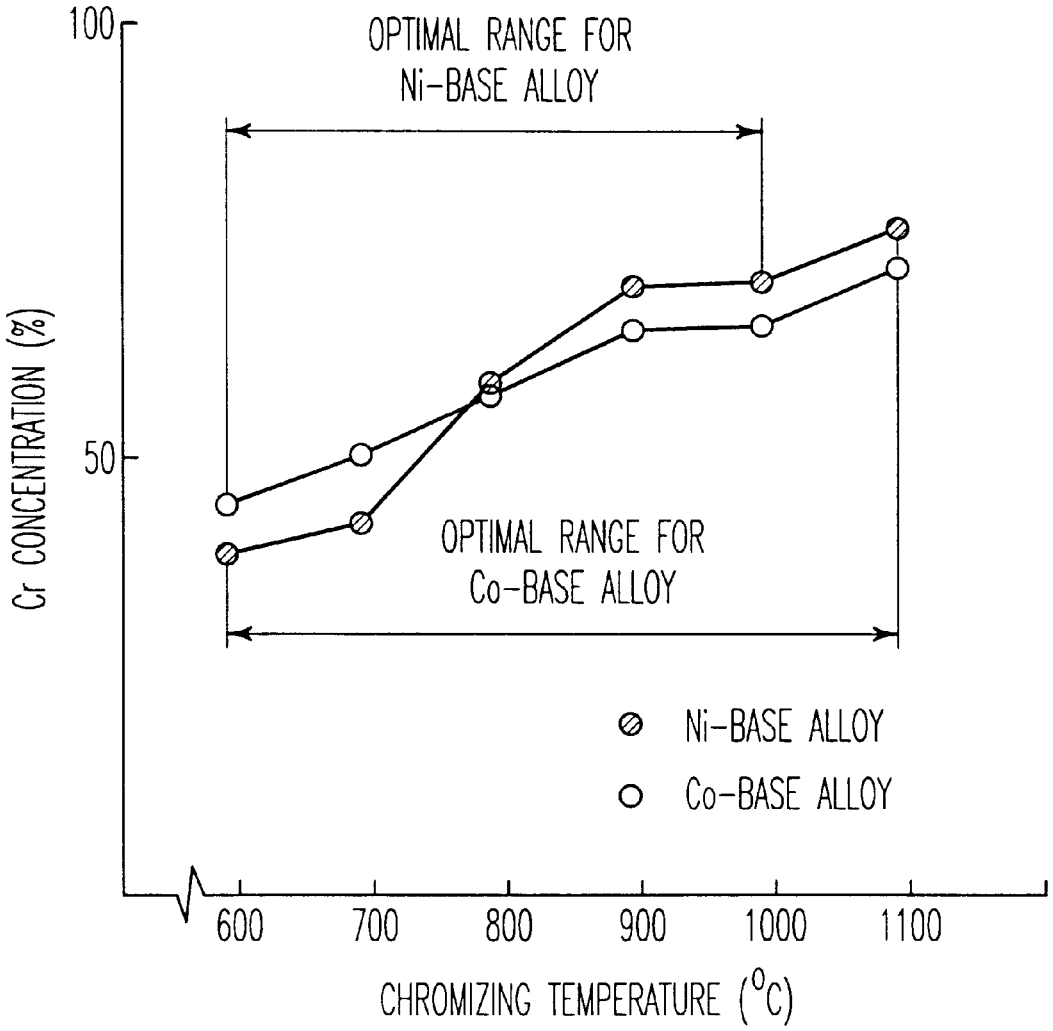
FIG. 6 is a graph showing the relationship between the Cr concentration in a chromized layer vs the temperature for chromization by the solid-phase procedure.
Figure 7:
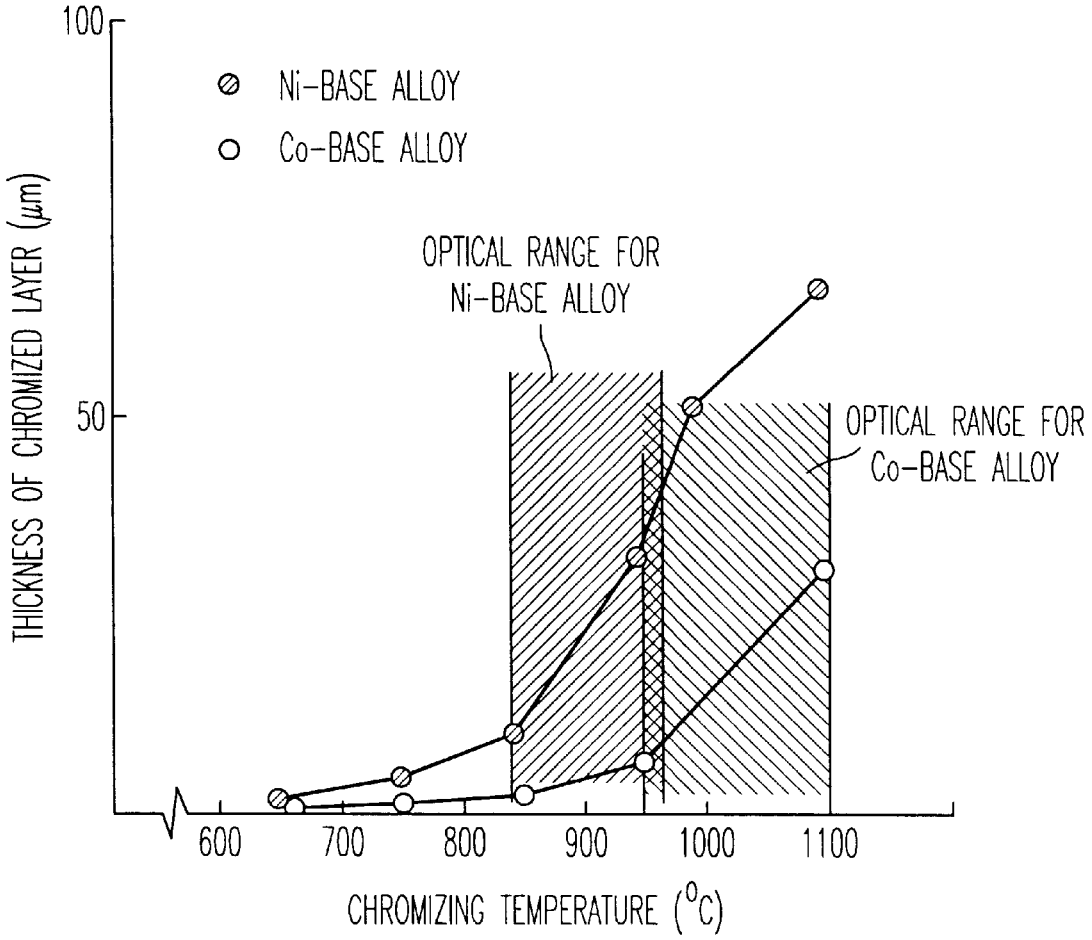
FIG. 7 is a graph showing the relationship between the thickness of a chromized layer vs the temperature for chromization by the solid-phase procedure.

FIG. 6 is a graph showing the profile of Cr concentration in the chromized layer of the test pieces that were chromized at varying temperatures, and FIG. 7 is a graph showing the thickness profile of the diffusion layer vs the chromizing temperature. Obviously, the higher the temperature, the higher the Cr concentration in the chromized layer and the thicker the chromized layer. Hence, one may conclude that when the present invention is to be implemented by the solid-phase procedure, the Cr concentration can be controlled by adjusting the chromizing temperature.

FIGS. 6 and 7 also show that in order to form the desired chromized layer on Ni-base alloys that has a Cr concentration of 25–80% and a diffusion thickness of 10–100 $\mu$m, chromization has to be conducted within the range 850–970° C. As for Co-base alloys, a chromized layer having high Cr concentration could be obtained; however, due to the large content of carbon in the alloy, the thickness of the diffusion layer had a tendency to become comparatively small. Therefore, as FIGS. 6 and 7 show, the chromizing temperature necessary to form the desired chromized layer on Co-base alloys that has a Cr concentration of 25–80% and a diffusion thickness of 10–100 $\mu$m is higher than is necessary for Ni-base alloys and lies within the range 950–1,100° C.

As one can also see from the results of Example 2, the relationship between the Cr concentration and the thickness of chromized layer is such that if the chromizing temperature to be used in an actual treatment is properly selected to insure the desired thickness of the chromized layer, the Cr concentration of the chromized layer can also be adjusted to lie within the desired range.

Example 3

Using the methods of Examples 1 and 2, chromized layers were formed at varying Cr concentrations on Ni-base and Co-base alloys and the thus prepared samples were numbered 2–5 and 7–10 and subjected to a hot corrosion test with sulfide under the following conditions.

(1) Corrosive gas 5 mol % $H_2S$ (2) Temperature 600° C.

(3) Time 100 h

Sample Nos. 1 and 6 were untreated test pieces of Ni- and Co-base alloys for comparison; sample Nos. 5 and 10 had Cr concentrations outside the range specified by the invention. The corrosion resistance of each test piece was evaluated by measuring its weight both before and after the corrosion test.

Table 2 shows the results of the corrosion test.

TABLE 2

| No. | Test Piece | | | Chromized layer: Cr Concentration wt % | Chromized layer: thickness μm | Amount of corrosion (mg/cm²) | Remarks |
|---|---|---|---|---|---|---|---|
| 1 | Ni-base alloy | | | 15 | 0 | 1.5 | com- |
| | C: | 0.04 | (wt %) | (untreated) | | | parison |
| 2 | Cr: | 15.0 | (wt %) | 25–36 | 15–20 | ≦0.1 | inven- |
| 3 | Ti: | 2.5 | (wt %) | 40–60 | 23–35 | ≦0.1 | tion |
| 4 | Fe: | 7.0 | (wt %) | 62–70 | 28–38 | ≦0.1 | |
| 5 | Ni: | bal. | (wt %) | 80–85 | 50–60 | ≦0.1 | com- |
| | | | | | | | parison |
| 6 | Co-base alloy | | | 26 | 0 | 2.8 | com- |
| | C: | 0.5 | (wt %) | (untreated) | | | parison |
| 7 | Cr: | 26.0 | (wt %) | 32–45 | 10–13 | ≦0.1 | inven- |
| 8 | Ni: | 10.0 | (wt %) | 44–60 | 11–16 | ≦0.1 | tion |
| 9 | W: | 7.5 | (wt %) | 61–77 | 28–38 | ≦0.1 | |
| 10 | Fe: | 2.0 | (wt %) | 80–85 | 42–45 | ≦0.1 | com- |
| | Mn: | 1.0 | (wt %) | | | | parison |
| | Co: | bal. | (wt %) | | | | |

As is verified from Table 2, if the chromized layer formed on Ni- or Co-base alloys has Cr concentrations of more than 35%, it exhibits comparable corrosion resistance to the chromized layer of high Cr concentration (about 80%) irrespective of the chromized thickness. Thus, it was found that excessively high Cr concentrations were unnecessary as far as corrosion resistance was concerned.

Example 4

A test was conducted in order to check the surface roughness and dimensional precision of shaped articles that were chromized in accordance with the present invention. The shaped articles were cylinders (30 mm$^{\Phi}$ and 10 mm$^{T}$) made of the Ni-base alloy used in Example 3.

These shaped articles were chromized as in Example 2 to yield products having chromized layers of the same properties as those possessed by sample Nos. 2–5 of Example 3. The amounts of deformation that occurred in those shaped articles as a result of chromization and their surface roughness data are shown in Table 3.

TABLE 3

| No. | Amount of deformation (per 10 mm of the length of shaped article before chromization) | Surface roughness |
|---|---|---|
| 2 | 10–16 μm | ≦10 μm |
| 3 | | |
| 4 | 20–40 μm | 10–15 μm |
| 5 | 40–60 μm | 20–40 μm |

Thus, sample Nos. 2–4 which were within the scope of the invention experienced only small deformations and retained small surface roughness values and, hence, the chromized shaped articles were usable without any trimming. On the other hand, sample No. 5, which had a Cr concentration and chromized thickness that were outside the ranges specified by the invention, experienced a large deformation and suffered an undue increase in surface roughness.

Example 5

A test was conducted in order to check the improvement in mechanical properties in the corrosive environment. The treated test species of the Ni-base alloy were chromized as in Example 2.

Figure 8:
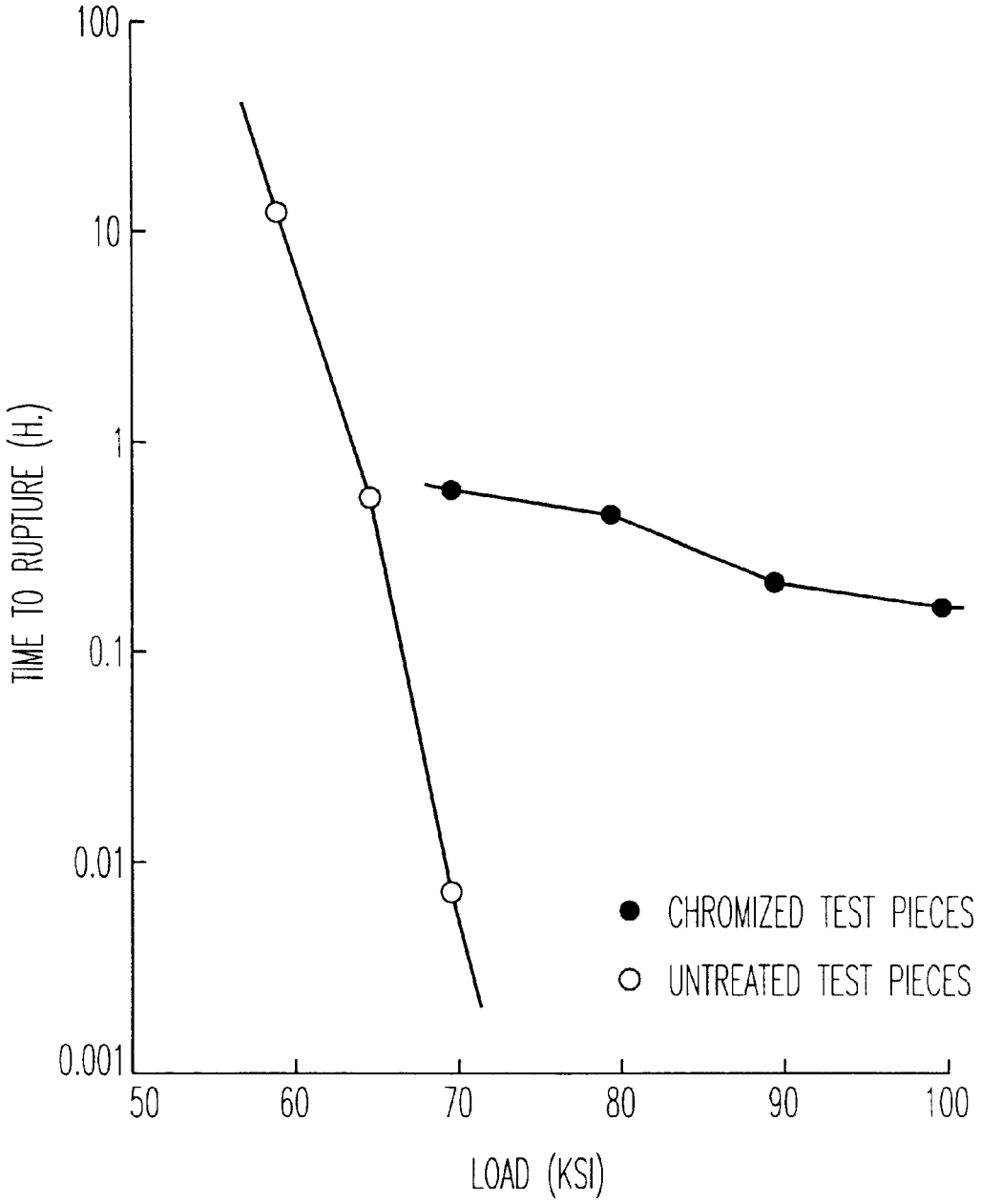
FIG. 8 is a graph comparing Ni-base heat-resistant chromized test pieces with untreated test pieces in terms of the time to rupture vs the load.

FIG. 8 shows the results of a stress rupture test conducted on Ni-base heat-resistant alloys at 800° C. in a heavy oil burnt gas atmosphere comparing with untreated test species. Obviously, the samples having the chromized according to the invention were improved in mechanical properties in the corrosive environment. The shape of the test samples was consistent with No. 4 in FIG. 1 and Table 1 in AMS 5704B whereas the test procedure was in compliance with ASTM E292.

Since Co-base heat-resistant alloys have similar physical properties to the Ni-base heat-resistant alloys, a comparable improvement will be achieved in the mechanical properties of the Co-base heat-resistant alloys.

As discussed in detail on the foregoing pages, particularly in the Examples, Ni- and Co-base heat-resistant alloy members that were chromized to meet the requirements of the present invention for the Cr concentration and chromized thickness exhibited outstanding performance in a hot corrosive environment. Even if they are placed in such environments that mechanically heavy loads are exerted, they will undergo only limited cracking and, furthermore, they will display satisfactory performance exemplified by limited cracking and as slow propagation of cracks. Additionally, chromization as performed under the conditions within the ranges specified by the invention is directly applicable to shaped articles and yet their surface roughness and dimensional precision are maintained within design tolerances so that the chromized shaped articles are suitable for use as close fitting and other mating parts.

Because of these advantages, the chromized heat-resistant alloys of the invention are expected to prolong the life of gas turbines, those elements of jet engines which are exposed to very high temperatures, as well as parts of various kinds of blowers that transport hot, corrosive gases, whereby improving the operating efficiency and safety of plants while reducing their operating cost.

What is claimed is:

1. A process for producing a chromized heat-resistant alloy member comprising the steps of:

packing a Ni- or Co-based heat resistant alloy member in a powder consisting essentially of chromium, aluminum oxide, and not more than one percent by weight, based on the powder of ammonium halide; and introducing hydrogen gas to the powder pack at a temperature ranging from 600–1100° C. for a time sufficient to form a chromized layer on the Ni- or Co-based heat resistant alloy, the chromized layer having a chromium concentration of 25–80% and a thickness of 10–100 μm.

2. The process of claim 1, wherein an amount of the hydrogen gas is not less than 1.5 times as much as one equivalent for the reaction $CrX_2+H_2 \rightarrow Cr+2HX$, wherein X represents halogen.

3. The process of claim 1, wherein the sufficient time is not more than 100 hours.

4. The process of claim 1, wherein the hydrogen gas is introduced into the powder pack at a temperature ranging from 850–970° C.

5. The process of claim 1, wherein a Ni-based heat resistant alloy member is used as said Ni- or Co-based heat resistant alloy; and, during the introduction step, the vapor pressure of chromium halide is kept in a range of 0.7–7 mmHg, and the temperature is kept in a range of 850–970° C.

6. The process of claim 1, wherein a Co-based heat resistant alloy member is used as said Ni- or Co-based heat resistant alloy; and, during the introduction step, the vapor pressure of chromium halide is kept in a range of 4–47 mmHg, and the temperature is kept in a range of 950–1100° C.

7. The process of claim 1, wherein the chromized layer has a thickness of 15–35 $\mu$m.

8. The process of claim 1, wherein the chromized layer has a thickness of 10–38 $\mu$m.

9. The process of claim 1, wherein said ammonium halide is ammonium chloride.

10. A process for producing a chromized heat-resistant alloy member, comprising the step of:

passing $CrCl_2$ vapor, hydrogen and an inert gas into a chamber containing a Ni-based heat resistant alloy member at a temperature ranging from about 850° C. to about 970° C. under a $CrCl_2$ vapor pressure ranging from about 0.7 to about 7 mmHg, thereby forming a surface chromized layer having a chromium concentration of 25–80% and a thickness ranging from 10–100 $\mu$m on the alloy member.

11. The process according to claim 10, wherein said alloy contains 2.5 wt. % titanium.

12. The process according to claim 10, wherein the alloy has the formula: 0.04C-15Cr-2.5Ti-7Fe-bal Ni.

13. The process of claim 10, wherein the $CrCl_2$ vapor, the hydrogen and the inert gas are passed into the chamber for a time sufficient to produce a chromized layer having a surface chromium concentration of 25–60% and a thickness of 15–35 $\mu$m.

14. The process of claim 10, wherein the vapor pressure of the hydrogen is not less than 1.5 times as much as one equivalent for the reaction $CrCl_2+H_2 \rightarrow Cr+2HC1$.

15. The process of claim 10, wherein the Ni-based heat resistant alloy is substantially free of cobalt.

16. A process for producing a chromized heat-resistant alloy member, comprising the step of:

passing $CrCl_2$ vapor, hydrogen and an inert gas into a chamber containing a Co-based heat resistant alloy member at a temperature ranging from about 950° C. to about 1100° C. under a $CrCl_2$ vapor pressure ranging from about 4 to about 47 mmHg for a time sufficient to form, thereby a surface chromized layer having a chromium concentration of 25–60% and a thickness ranging from 15–35 $\mu$m on the alloy member.

17. The process according to claim 10, which further comprises:

diffusing the chromium in the additive layer in the chromized layer into the non-cobalt containing Ni-based heat-resistant alloy by effecting a post-heat treatment at a temperature of from 600 to 1000° C. for a time sufficient to effect the diffusion of the Cr into the member being treated.

18. The process according to claim 16, wherein said alloy contains 2.5 wt. % titanium.

19. The process according to claim 16, wherein the alloy has the formula: 0.04C-15Cr-2.5Ti-7Fe-bal Ni.

20. The process of claim 16, wherein the vapor pressure of the hydrogen is not less than 1.5 times as much as one equivalent for the reaction $CrCl_2+H_2 \rightarrow Cr+2HC1$.

21. The process of claim 16, wherein the Co-based heat-resistant alloy is substantially free of nickel.

* * * * *

UNITED STATES PATENT AND TRADEMARK OFFICE

CERTIFICATE OF CORRECTION

PATENT NO. : 5,958,152

DATED : September 28, 1999

INVENTOR(S): Syuhei NAKAHAMA et al.

It is certified that an error appears in the above-identified patent and that said Letters Patent is hereby corrected as shown below:

On the title page, item [75], the 1st inventor's name should be:

--Syuhei Nakahama--

Signed and Sealed this

Twenty-first Day of November, 2000

*Attest:*

Q. TODD DICKINSON

*Attesting Officer*

*Director of Patents and Trademarks*